US009741523B2

(12) United States Patent
Kanasaki et al.

(10) Patent No.: US 9,741,523 B2
(45) Date of Patent: Aug. 22, 2017

(54) X-RAY TUBE

(71) Applicant: Toshiba Electron Tubes & Devices Co., Ltd., Otawara-shi (JP)

(72) Inventors: Hiroshi Kanasaki, Kawasaki (JP); Hideyuki Takahashi, Otawara (JP); Keiichi Mimori, Nasu (JP); Masataka Ueki, Nasushiobara (JP)

(73) Assignee: Toshiba Electron Tubes & Devices Co., Ltd., Otawara-shi (JP)

( * ) Notice: Subject to any disclaimer, the term of this patent is extended or adjusted under 35 U.S.C. 154(b) by 161 days.

(21) Appl. No.: 14/508,386

(22) Filed: Oct. 7, 2014

(65) Prior Publication Data

US 2016/0099128 A1 Apr. 7, 2016

Related U.S. Application Data

(63) Continuation of application No. PCT/JP2013/060640, filed on Apr. 8, 2013.

(30) Foreign Application Priority Data

Apr. 12, 2012 (JP) ..... 2012-090913

(51) Int. Cl.
*H01J 35/06* (2006.01)

(52) U.S. Cl.
CPC ..... *H01J 35/06* (2013.01)

(58) Field of Classification Search
CPC ..... H01J 35/06
USPC ..... 378/119, 121, 122, 136
See application file for complete search history.

(56) References Cited

U.S. PATENT DOCUMENTS

| | | | |
|---|---|---|---|
| 4,064,411 | A | 12/1977 | Iwasaki et al. |
| 5,907,595 | A | 5/1999 | Sommerer |
| 2007/0183576 | A1 | 8/2007 | Burke et al. |

FOREIGN PATENT DOCUMENTS

| | | | |
|---|---|---|---|
| JP | 36-726 | Y1 | 1/1961 |
| JP | 50-117770 | | 9/1975 |
| JP | 57-17495 | Y2 | 4/1982 |
| JP | 59-165353 | A | 9/1984 |
| JP | 2-144835 | A | 6/1990 |
| JP | 2-128357 | | 10/1990 |
| JP | 5-53115 | U | 7/1993 |
| JP | 2007-207757 | A | 8/2007 |

OTHER PUBLICATIONS

International Search Report dated May 14, 2013 for PCT/JP2013/060640 filed on Apr. 8, 2013 with English Translation.

(Continued)

*Primary Examiner* — Courtney Thomas
(74) *Attorney, Agent, or Firm* — Oblon, McClelland, Maier & Neustadt, L.L.P.

(57) ABSTRACT

According to one embodiment, an X-ray tube includes an elongated anode target, a cathode, and a vacuum envelope. The cathode includes an electron emission source and a converging electrode including a trench portion. The trench portion includes a closest inner circumferential wall, an upper inner circumferential wall, and a lower inner circumferential wall. The electron emission source projects towards a opening of the trench portion from a boundary between the closest inner circumferential wall and the upper inner circumferential wall.

7 Claims, 9 Drawing Sheets

(56) References Cited

OTHER PUBLICATIONS

International Written Opinion dated May 14, 2013 for PCT/JP2013/060640 filed on Apr. 8, 2013.
Combined Chinese Office Action and Search Report dated Dec. 1, 2015 in Patent Application No. 201380019796.9 (with English language translation).

X-RAY TUBE

CROSS REFERENCE TO RELATED APPLICATIONS

This application is a Continuation Application of PCT Application No. PCT/JP2013/060640, filed Apr. 8, 2013 and based upon and claiming the benefit of priority from Japanese Patent Application No. 2012-090913, filed Apr. 12, 2012, the entire contents of all of which are incorporated herein by reference.

FIELD

Embodiments described herein relate generally to an X-ray tube.

BACKGROUND

X-ray tubes are used for X-ray image diagnosis, non-destructive inspection and the like. The X-ray tubes include a stationary anode type and a rotating anode type, which can be selected according to use. An X-ray tube comprises an anode target, a cathode and a vacuum envelope. The anode target is configured to emit X-ray by incidence of an electron beam.

The cathode comprises a filament coil and an electron converging cup. The filament coil is configured to emit electrons. A high tube voltage in the range of several tens to several hundreds of kilovolts (kV) is applied between the anode target and the cathode. In this manner, the electron converging cup can act an electron lens and converge an electron beam emitted towards the anode target. The electron converging cup comprises a trench portion in which the filament coil is accommodated. The trench portion comprises an upper inner circumferential wall and a lower inner circumferential wall located on an opposite side to the anode target with respect to the upper inner circumferential wall and having dimensions smaller than those of the upper inner circumferential wall.

DETAILED DESCRIPTION

In general, according to one embodiment, there is provided an X-ray tube comprises:

an anode target configured to radiate X-rays by incidence of an electron beam;

a cathode comprising an elongated electron emission source configured to emit electrons, and a converging electrode including a trench portion accommodating the electron emission source, and configured to converge the electron beam towards the anode target through an opening of the trench portion as the electrons are emitted from the electron emission source, and a vacuum envelope accommodating the anode target and the cathode, wherein the trench portion comprises:

a closest inner circumferential wall extending linearly in a depth direction of the trench portion, having dimension shorter than dimension of the electron emission source in the depth direction of the trench portion, and facing the electron emission source with a narrowest gap between the closest inner circumferential wall and the electron emission source over an entire circumference of the electron emission source in width direction of the electron emission source, an upper inner circumferential wall located on an opening side of the trench portion with respect to the closest inner circumferential wall and having a shape widening in the width direction further from the closest inner circumferential wall, and a lower inner circumferential wall located on an opposite side to the upper inner circumferential wall with respect to the closest inner circumferential wall and having a shape widening in the width direction further from the closest inner circumferential wall, and the electron emission source projects towards the opening of the trench portion from a boundary between the closest inner circumferential wall and the upper inner circumferential wall.

An X-ray tube assembly according to the first embodiment will now be described in detail with reference to accompanying drawings. In this embodiment, the X-ray tube assembly is of the rotating anode type.

Figure 1:
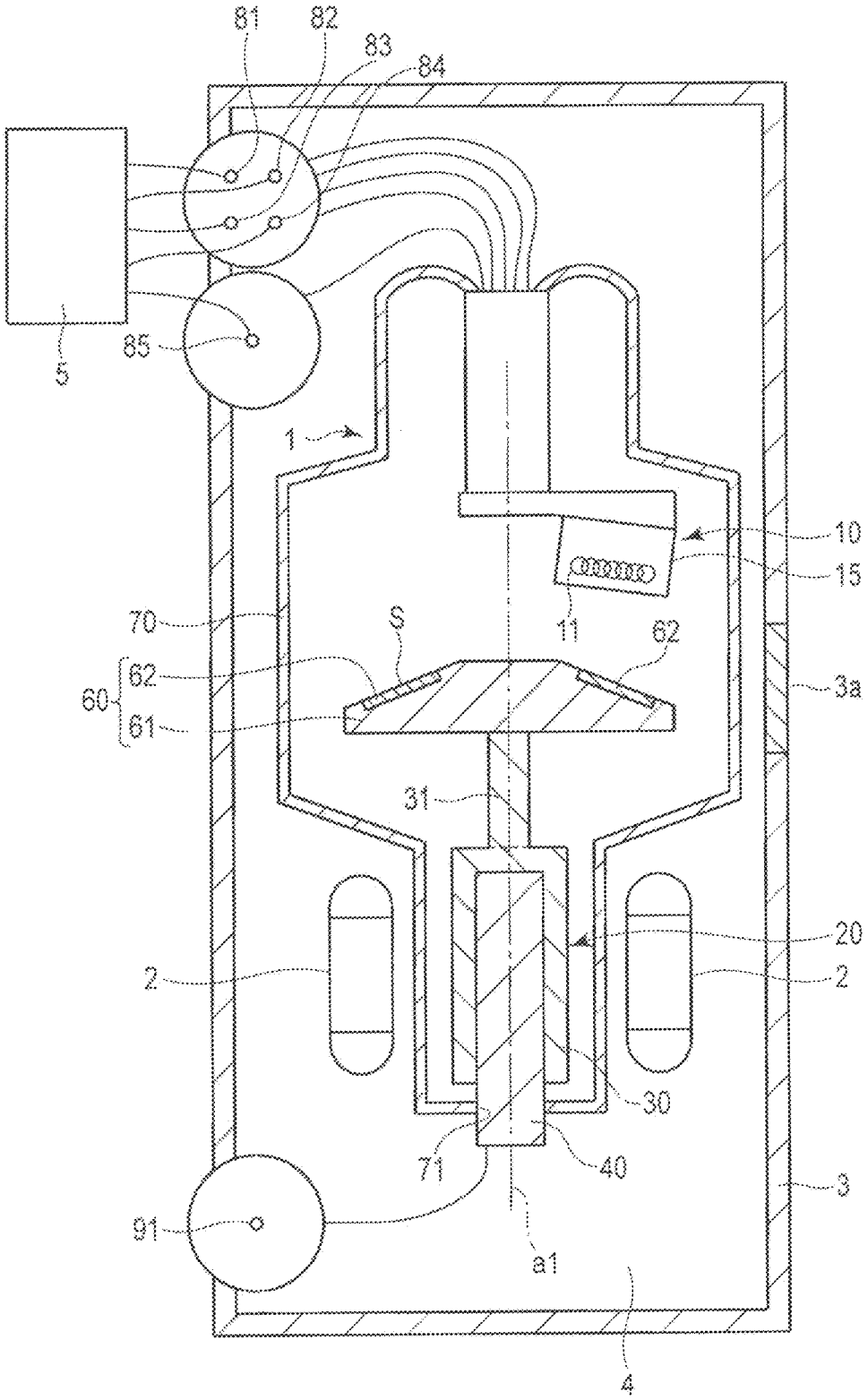
FIG. 1 is a cross-sectional view of an X-ray tube assembly according to a first embodiment.

As shown in FIG. 1, the X-ray tube assembly comprises a rotating anode X-ray tube 1, a stator coil 2 serving as a coil to generate a magnetic field, a housing 3 to accommodate the X-ray tube and the stator coil, and insulating oil 4 filled in the housing as a coolant.

The X-ray tube 1 comprises a cathode (cathode electron gun) 10, a sliding bearing unit 20, an anode target 60 and a vacuum envelope 70. A control unit 5 of an X-ray apparatus (not shown) in which an X-ray tube assembly is mounted, is electrically connected to the cathode 10.

The sliding bearing unit 20 comprises a rotor 30, a fixed shaft 40 serving as a fixed member and a liquid metal lubricant (not shown) as a lubricant, and thus employs sliding bearing.

The rotor 30 is formed into a cylindrical shape, one end of which is blocked. The rotor 30 extends along a central axis of rotation thereof. In this embodiment, the axis of rotation is the same as a tube axis al of the X-ray tube 1, and will be described as the tube axis al hereinafter. The rotor 30 is rotatable around the tube axis al. The rotor 30 comprises a joint member 31 located at one end thereof. The rotor 30 is formed of a material such as iron (Fe) or molybdenum (Mo).

The fixed shaft 40 is formed to have a cylindrical shape having dimensions smaller than those of the rotor 30. The fixed shaft 40 is provided coaxially with the rotor 30, and extends along the tube axis al. The fixed shaft 40 is engaged with an internal part of the rotor 30. The fixed shaft 40 is formed of a material such as Fe or Mo. One end of the fixed shaft 40 is exposed to the outside of the rotor 30. The fixed shaft 40 rotatably supports the rotor 30.

The liquid metal lubricant is applied so that it fills the space between the rotor 30 and the fixed shaft 40.

The anode target 60 is disposed along the tube axis al such that it faces the other end of the fixed shaft 40. The anode target 60 comprises an anode main body 61 and a target layer 62 provided partially on an outer surface of the anode main body 61.

The anode main body 61 is secured to the rotor 30 via the joint member 31. The anode main body 61 has a disk-like shape and is made of a material such as Mo.

The anode main body 61 is rotatable around the tube axis al. The target layer 62 is formed into a ring-like shape. The target layer 62 comprises a target surface S which faces the cathode 10 in the direction along the tube axis al with an interval therebetween. In the anode target 60, a focal spot is formed on the target surface S when an electron beam is made incident on the target surface S, and then X-ray is radiated from the focal spot.

The anode target 60 is electrically connected to a terminal 91 via the fixed shaft 40, the rotor 30 and the like.

Figure 2:
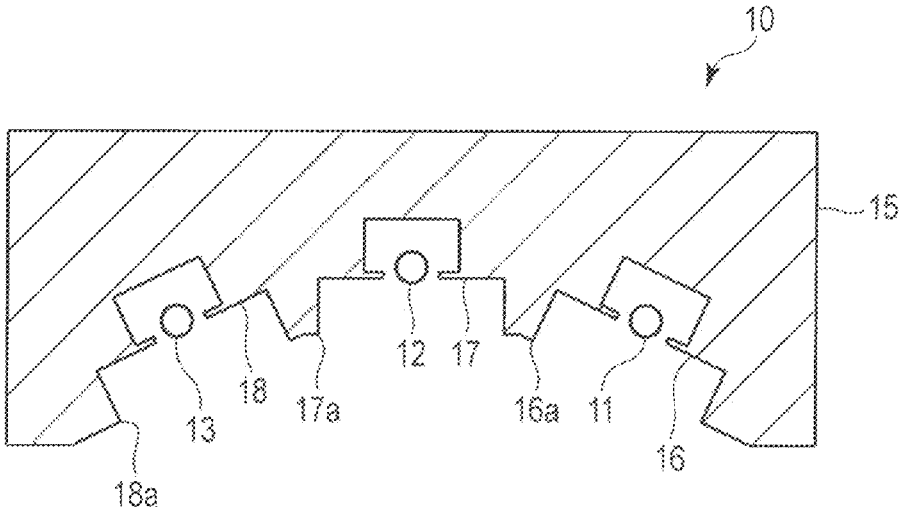
FIG. 2 is an enlarged cross-sectional view of an cathode illustrated in FIG. 1.
Figure 3:
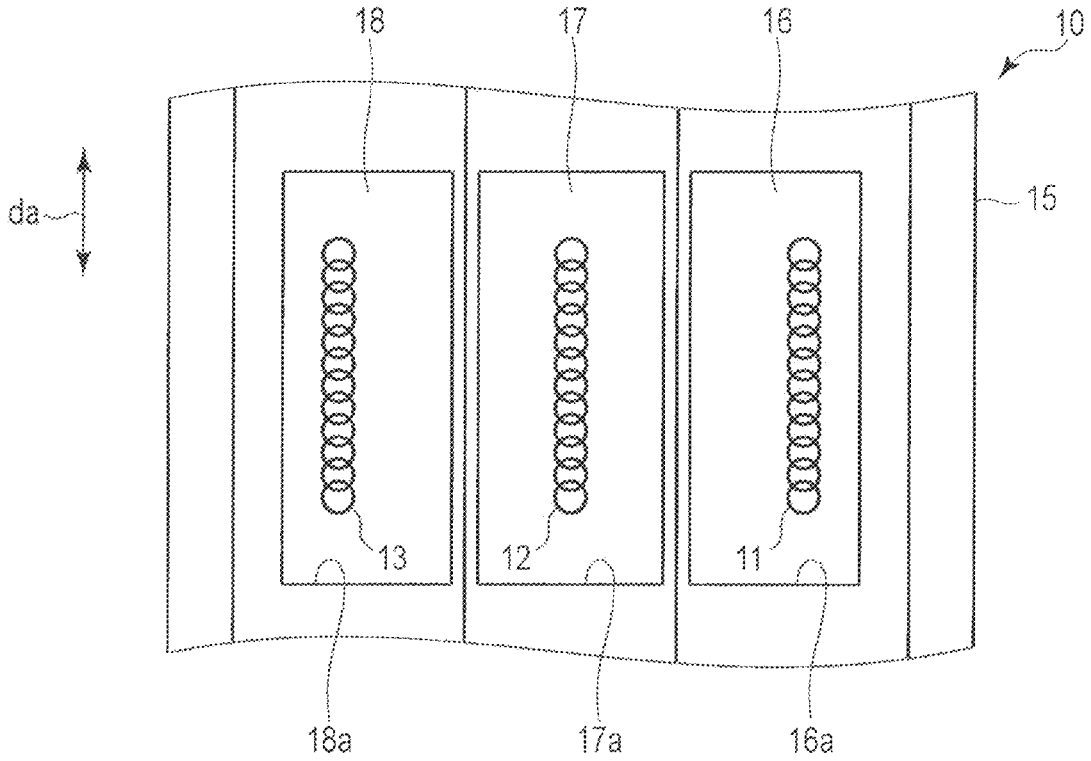
FIG. 3 is an enlarged cross-sectional view of a section of the cathode illustrated in FIGS. 1 and 2 as viewed from an anode target side.

As shown in FIGS. 1, 2 and 3, the cathode 10 comprises one or more electron emission sources and the electron converging cup 15 as a converging electrode. In this embodiment, the cathode 10 comprises a first filament coil 11, a second filament coil 12 and a third filament coil 13, each serving as an electron emission source. The first to third filament coils 11 to 13 are arranged in the direction of rotation of the anode target 60 at intervals. The first filament coil 11 and the third filament coil 13 are each disposed on an inclined surface. The first to third filament coils 11 to 13 are formed of a material, a main component of which is tungsten.

The first to third filament coils 11 to 13 and the electron converging cup 15 are electrically connected to terminals 81, 82, 83, 84 and 85.

The electron converging cup 15 comprises one or more trench portions configured to accommodate filament coils (electron emission sources), respectively. In this embodiment, the electron converging cup 15 comprises three trench portions (a first trench portion 16, a second trench portion 17 and a third trench portion 18) in which the first to third filament coils 11 to 13 are respectively accommodated.

A current (filament current) is supplied to the first to third filament coils 11 to 13, and thus, the first to third filament coils 11 to 13 emit electrons (thermoelectrons).

A relatively positive voltage is applied to the anode target 60 from the terminal 91 via the fixed shaft 40, the rotor 30 and the like. Conversely, a relatively negative voltage is applied to the first to third filament coils 11 to 13 and the electron converging cup 15 from the terminals 81 to 84 and terminal 85.

An X-ray tube voltage (referred to as tube voltage hereinafter) is applied between the anode target 60 and the cathode 10, and therefore the electrons emitted from the first to third filament coils 11 to 13 are accelerated and made incident on the target surface S as electron beam.

The electron converging cup 15 is configured to converge the beam of electrons emitted from the first to third filament coils 11 to 13 towards the anode target 60 through openings 16*a* to 18*a* of the first to third trench portions 16 to 18.

As shown in FIG. 1, the vacuum envelope 70 is cylindrical. The vacuum envelope 70 is formed of a combination of insulating materials such as glass and ceramics, metals, etc. In the vacuum envelope 70, the diameter of a portion thereof which faces the anode target 60, is larger than that of another portion facing the rotor 30. The vacuum envelope 70 comprises an opening 71. The opening 71 is tightly attached to one end of the fixed shaft 40 in order to maintain the vacuum-tightness of the vacuum envelope 70. The vacuum envelope 70 fixates the fixed shaft 40. In the vacuum envelope 70, the cathode 10 is mounted on an inner wall thereof. The vacuum envelope 70 is sealed, and accommodates the cathode 10, the sliding bearing unit 20, the anode target 60, etc. The inside of the vacuum envelope 70 is maintained in a vacuum state.

The stator coil 2 is provided to surround the vacuum envelope 70 while facing a side surface of the rotor 30. The stator coil 2 has a ring-like shape. The stator coil 2 is electrically connected to the terminals 92 and 93 (not shown) and driven via these terminals.

The housing 3 comprises an X-ray transmitting window 3*a* configured to transmit X-rays to a vicinity of the target layer 62 facing the cathode 10. The housing 3 accommodates the X-ray tube 1 and the stator coil 2, and is further filled with the insulating oil 4.

The control unit 5 is electrically connected to the cathode 10 via the terminals 81, 82, 83, 84 and 85. The control unit 5 is configured to drive one of the first to third filament coils 11 to 13, or two or more of the first to third filament coils 11 to 13, or to apply a voltage to the electronic convergence cup 15 so that the potential of the electronic convergence cup 15 may become lower than the potential of a filament coil.

Next, the X-ray radiating operation of the above-described X-ray tube assembly will now be described.

As shown in FIGS. 1 to 3, when the X-ray tube assembly is in operation, first, the stator coil 2 is driven via the terminals 92 and 93, and thus generates a magnetic field. That is, the stator coil 2 produces a rotating torque to be applied to the rotor 30. With this structure, the rotor rotates, and the anode target 60 rotates therewith.

Next, the control unit 5 supplies a current to at least one of the first to third filament coils 11 to 13 to be driven, via the respective ones of the terminals 81 to 84. A relatively negative voltage is applied to the filament coils to be driven. A relatively positive voltage is applied to the anode target 60 via the terminal 91.

Since the tube voltage is applied between the filament coil (cathode 10) and the anode target 60, the electrons emitted from the respective filament coil are converged and accelerated and collide with the target layer 62. In other words, an X-ray tube current (referred to as the tube current hereinafter) flows from the cathode 10 to a focal spot on the target surface S.

The target layer 62 radiates X-rays by the incidence of the electron beam, and the X-rays radiated from the focal spot are transmitted to the outside of the housing 3 through the X-ray transmission window 3*a*. Thus, X-ray imaging is performed.

Next, the structure of the X-ray tube assembly of an example according to the embodiment and the structure of an X-ray tube assembly of a comparative example will now be described. The X-ray tube assemblies of the example and comparative example are manufactured similarly except for the trench portions of the electron converging cup 15. The first to third trench portions 16 to 18 are formed to be similar to each other, and therefore only the first trench portion 16 will be considered in the following description.

(Comparative Example)

Figure 12:
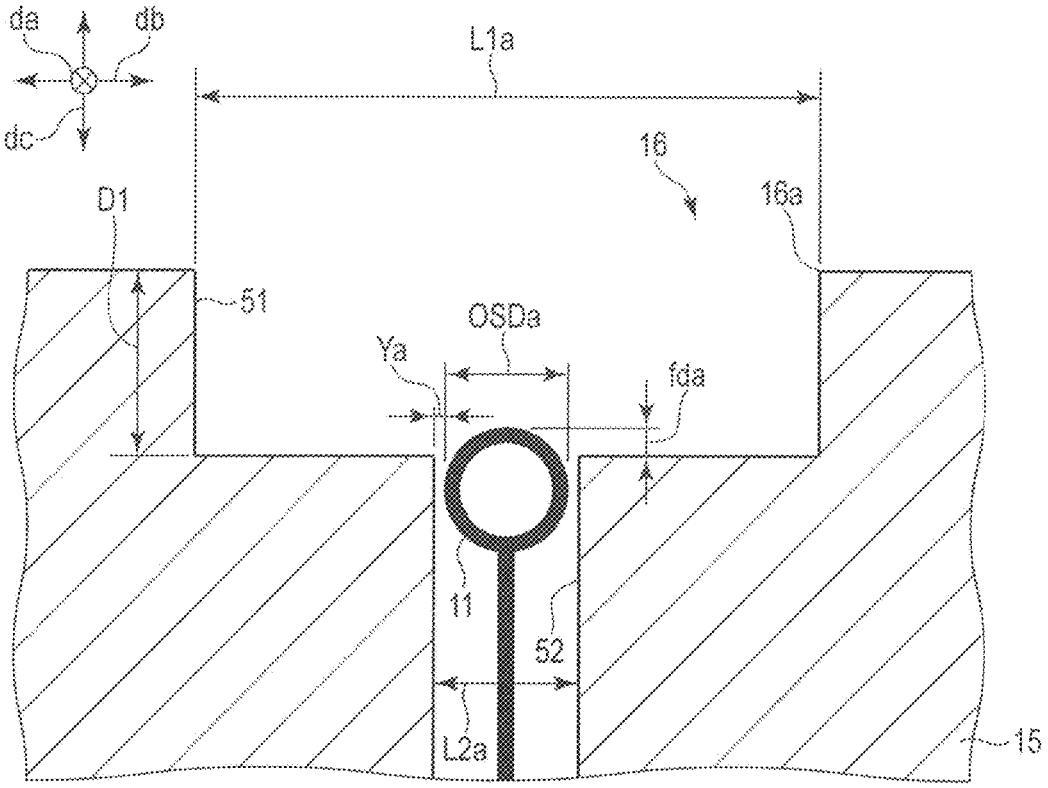
FIG. 12 is an enlarged cross-sectional view of an cathode of a comparative example according to the first embodiment.
Figure 13:
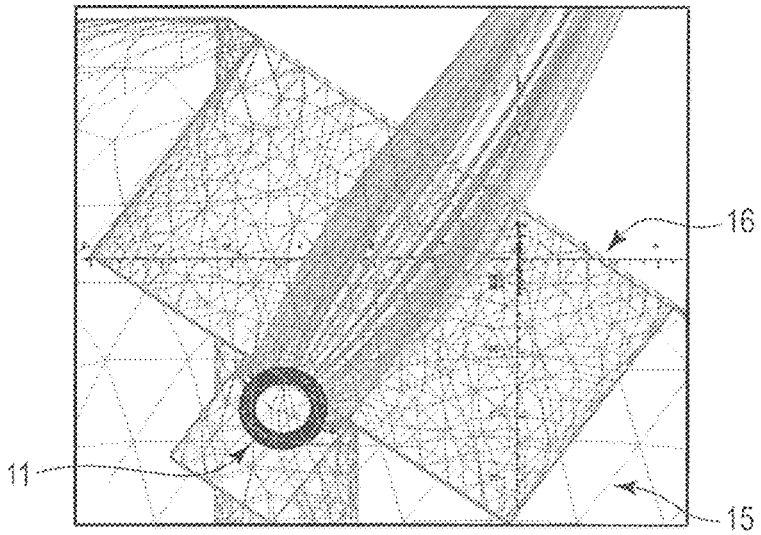
FIG. 13 is an enlarged cross-sectional view of a first filament coil and a first trench portion of the comparative example, illustrating that an electron beam is emitted from the first filament coil.

As shown in FIGS. 12 and 13, an opening 16*a* of the first trench portion 16 has a rectangular shape having sides in a first direction da, which extends from the first filament coil 11, and sides in a second direction db, which orthogonally crosses the first direction da. The depth direction of the first trench portion 16 is a third direction dc, which orthogonally crosses the first direction da and the second direction db.

The first trench portion 16 comprises an upper inner circumferential wall 51 and a lower inner circumferential wall 52.

The upper inner circumferential wall 51 is located on the side of the opening 16*a* of the first trench portion 16, that is, an upper section of the first trench portion 16. The upper inner circumferential wall 51 is formed into a rectangular frame shape to have the same dimensions as those of the opening 16*a* in a plane in the first direction da and the second direction db.

The lower inner circumferential wall 52 is located on the opposite side to the electron beam emitting direction with respect to the upper inner circumferential wall 51, that is, a lower section of the first trench portion 16 underneath the upper inner circumferential wall 51. The lower inner circumferential wall 52 is formed into a rectangular frame shape to have dimensions smaller as those of the upper inner circumferential wall 51 in a plane in the first direction da and the second direction db.

In this comparative example, the diameter of the first filament coil 11 is defined as OSDa, the width of the upper inner circumferential wall 51 in the second direction db as L1*a*, the depth of the upper inner circumferential wall 51 (that is, the length from the furthermost end of the upper inner circumferential wall 51 from the opening 16*a* to the opening 16*a* in the third direction dc) as D1*a*, the width of the lower inner circumferential wall 52 in the second direction db as L2*a*, the fd value, which indicates the projection of the first filament coil 11 towards the opening 16*a* from the boundary between the upper inner circumferential wall 51 and the lower inner circumferential wall 52, is defined as fda. The gap between the first filament coil 11 and the lower inner circumferential wall 52 in the second direction db is defined as Ya.

(Example)

Figure 4:
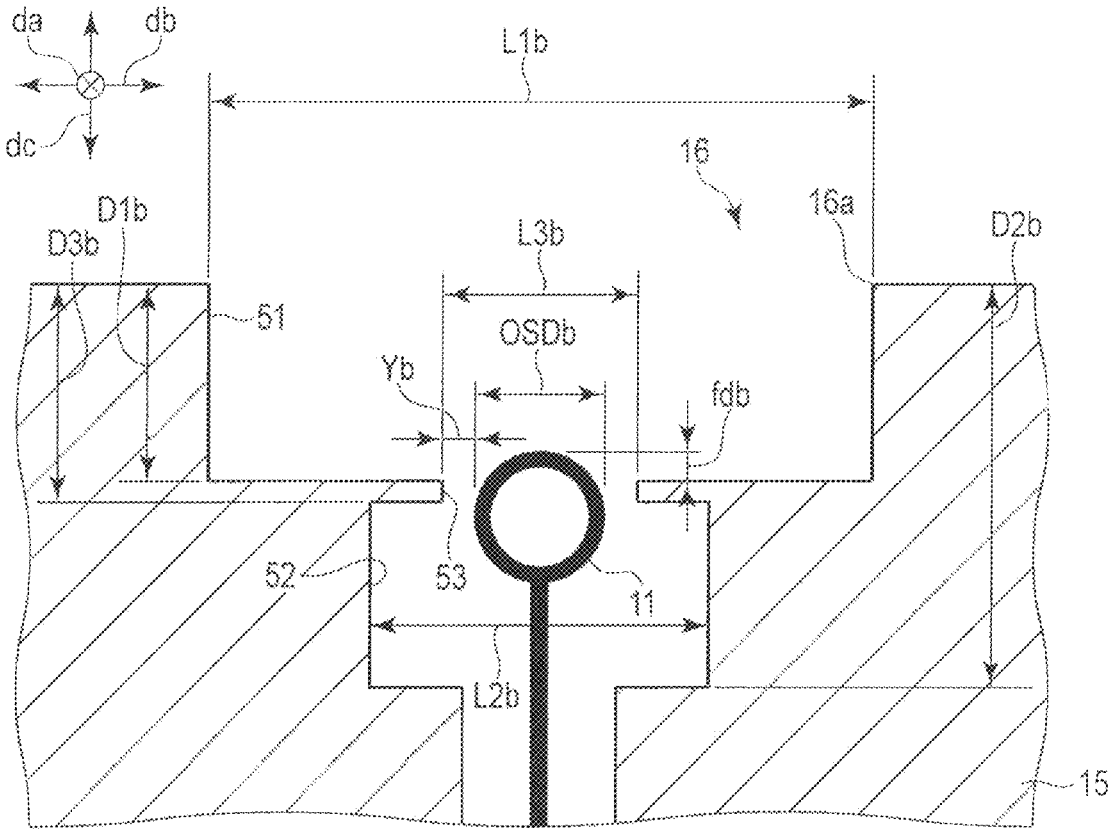
FIG. 4 is an enlarged cross-sectional view of an cathode of an example according to the first embodiment.

As shown in FIG. 4 and also FIGS. 2 and 3, the opening 16*a* of the first trench portion 16 has a rectangular shape having sides in the first direction da and sides in the second direction db. The depth direction of the first trench portion 16 is the third direction dc.

The first trench portion 16 comprises a closest inner circumferential wall 53, an upper inner circumferential wall 51 and a lower inner circumferential wall 52.

The closest inner circumferential wall 53 is shorter than a dimension (diameter) of the first filament coil 11 in the third direction dc. The closest inner circumferential wall 53 is formed into a rectangular frame shape. The closest inner circumferential wall 53 faces the first filament coil 11 in the width direction of the first trench portion 16 along the second direction db with a narrowest gap.

The upper inner circumferential wall 51 is located on the nearer side to the opening 16*a* of the first trench portion 16 than the closest inner circumferential wall 53. The upper inner circumferential wall 51 is formed into a rectangular frame shape to have the same dimensions as those of the opening 16*a* in a plane in the first direction da and the second direction db, and also dimensions larger than those of the closest inner circumferential wall 53. The upper inner circumferential wall 51 in a plane in the second direction db and the third direction dc extends linearly in the third direction dc. The upper inner circumferential wall 51 has a shape widening further from the closest inner circumferential wall 53 in the width direction (the second direction db).

The lower inner circumferential wall 52 is located on the opposite side to the upper inner circumferential wall 51 with respect to the closest inner circumferential wall 53. The lower inner circumferential wall 52 is formed into a rectangular frame shape to have dimensions larger than those of the closest inner circumferential wall 53 in the second direction db. The lower inner circumferential wall 52 in a plane in the second direction db and the third direction dc extends linearly in the third direction dc. The lower inner circumferential wall 52 has a shape widening further from the closest inner circumferential wall 53 in the width direction (the second direction db).

In this example, the diameter of the first filament coil 11 is defined as OSDb, the width of the upper inner circumferential wall 51 in the second direction db as L1*b*, the depth of the upper inner circumferential wall 51 (that is, the length from the furthermost end of the upper inner circumferential wall 51 from the opening 16*a* to the opening 16*a* in the third direction dc) as D1*b*, the width (minimum width) of the closest inner circumferential wall 53 along the second direction db as L3*b*, the depth of the closest inner circumferential wall 53 (that is, the length from the furthermost end of the closest inner circumferential wall 53 from the opening 16*a* to the opening 16*a* in the third direction dc) as D3*b*, the width (maximum width) of the lower inner circumferential wall 52 in the second direction db as L2*b*, the depth of the lower inner circumferential wall 52 (that is, the length from the furthermost end of the lower inner circumferential wall 52 from the opening 16*a* to the opening 16*a* in the third direction dc) as D2*b*, the fd value, which indicates the projection of the first filament coil 11 towards the opening 16*a* from the boundary between the upper inner circumferential wall 51 and the closest inner circumferential wall 53, is defined as fdb. The gap between the first filament coil 11 and the closest inner circumferential wall 53 in the second direction db is defined as Yb.

Next, the results of comparison and contrast between the example and comparative example in terms of the dimensions of the first trench portion 16 and the first filament coil 11 will now be provided.

$$OSDb=OSDa$$

$$Yb=Ya+X$$

$$L1a \leq L1b \leq L1a + 2 \cdot 0.75 \text{ mm} \cdot X$$

$$L3b = L2a + 2 \cdot X$$

Further, the dimensions of the first trench portion 16 of this example satisfy the following relationships:

$$1.5 \cdot L3b \leq L2b \leq 2.0 \cdot L3b$$

$$D1b < D3b < D1b + 0.5 \text{ mm}$$

X represents the expansion of the gap between the first filament coil 11 and the first trench portion 16 in the second direction db.

The dimensions of the first trench portion 16 and the first filament coil 11 of the example are as follows.

OSDb=1.23 mm
L1*b*=7.5 mm
D1*b*=4.1 mm
L3*b*=2.2 mm
D3*b*=4.2 mm
L2*b*=3.0 mm
D2*b*=6 mm
fdb=0.300 mm
Yb=0.485 mm Here, the present inventors conducted a computer simulation of electron beam trajectory by using the X-ray tube assembly according to the embodiment and another computer simulation of electron beam trajectory by using the X-ray tube assembly according to the comparative example. In these simulations, only the first filament coil 11 of the first to third filament coils 11 to 13 was driven. Therefore, the focal spot formed on the target surface S was a single focal spot. The simulations were carried out under the same conditions.

First, the procedure and results of the simulation of electron beam trajectory by using the X-ray tube assembly according to the embodiment will be described.

Figure 5:
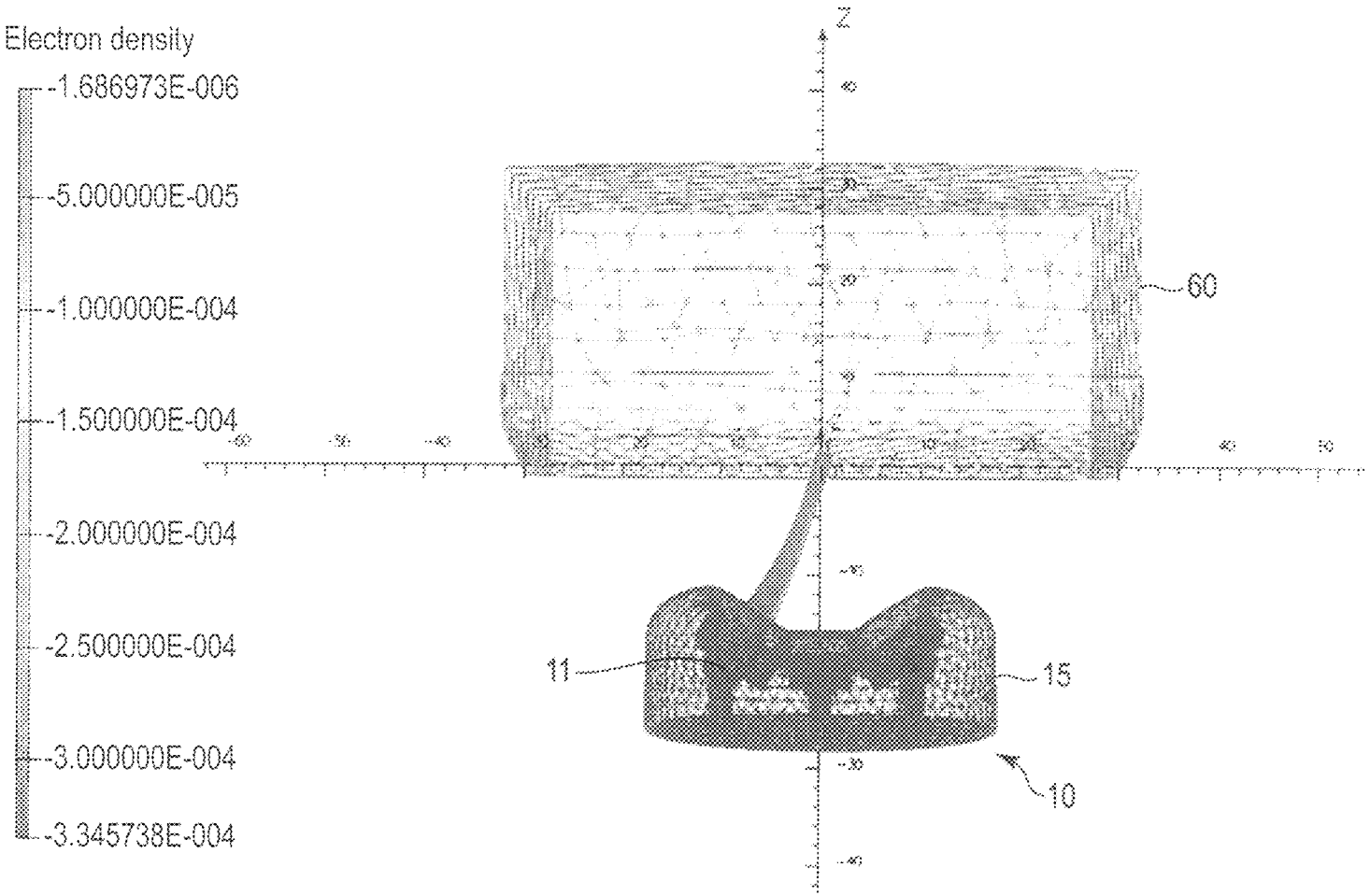
FIG. 5 is a schematic view of the cathode and an anode target of the example, illustrating that an electron beam is emitted from a first filament coil towards the anode target.
Figure 6:
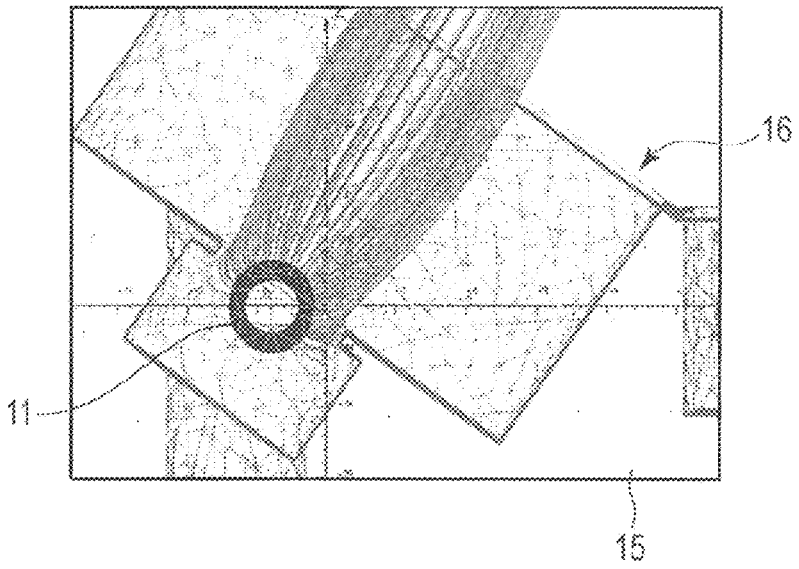
FIG. 6 is an enlarged cross-sectional view of the first filament coil illustrated in FIG. 5 and a first trench portion.

As shown in FIGS. 5 and 6, only the first filament coil 11 was driven for emitting electrons. Electrons emitted from the first filament coil 11 were made incident on the target surface S of the anode target 60 as an electron beam. The electron beam was converged by the effect of the electric field produced by the first trench portion 16 of the electron converging cup 15.

Then, the main focal spot formed by the electrons emitted from the upper surface (on the anode target 60 side) of the first filament coil 11 and the sub-focal spot formed by the electrons emitted from the side surface of the first filament coil 11 are made to substantially coincide with each other in position and dimensions.

Figure 7:
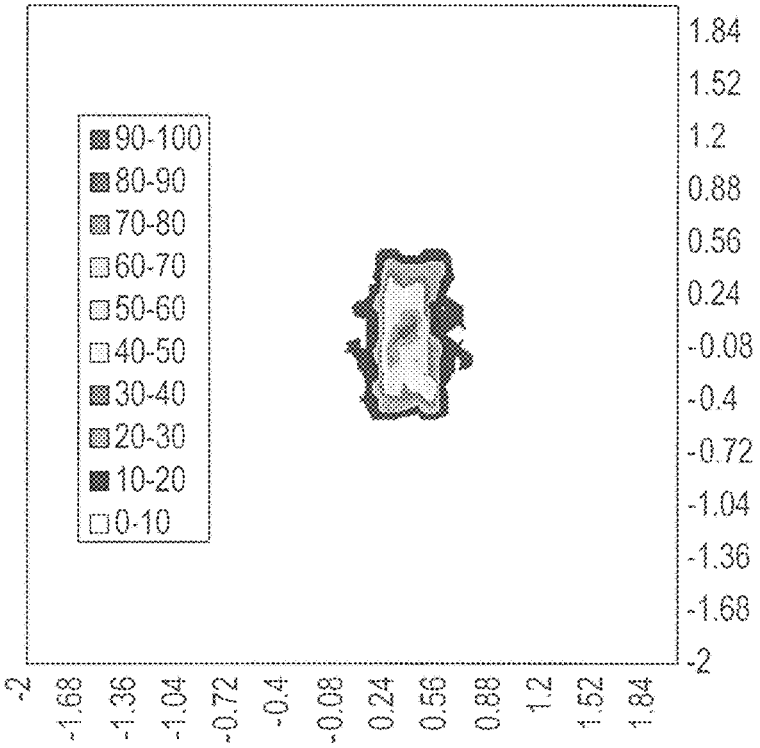
FIG. 7 is a diagram illustrating an in-focus image Fb calculated so as to be equivalent to that of a pinhole camera method in the X-ray tube of the example.

The results of the electron density distribution in the focal spot were as shown in FIG. 7. The region where the electron density is at maximum was indicated as 100%. FIG. 7 shows an electron density distribution when the target surface S was viewed from a direction vertical to the tube axis al.

The width of the effective focal spot Fb in a direction dd along the direction of rotation of the anode target 60 was 0.552 mm. The length of the effective focal spot Fb in a direction de along the tube axis al was 1.004 mm. Note that in order be in conformity with IEC standards, it suffices if the width of the effective focal spot Fb is 0.75 mm or less, and the length of the effective focal spot Fb is 1.1 mm or less.

Next, the procedure and results of the simulation of electron beam trajectory by using the X-ray tube assembly according to the comparative example will be described.

As shown in FIG. 13, only the first filament coil 11 was driven for emitting electrons. Electrons emitted from the first filament coil 11 were made incident on the target surface S of the anode target 60 as an electron beam. The electron beam was converged by the effect of the electric field produced by the first trench portion 16 of the electron converging cup 15.

Then, the main focal spot formed by the electrons emitted from the upper surface (on the anode target 60 side) of the first filament coil 11 and the sub-focal spot formed by the electrons emitted from the side surface of the first filament coil 11 are made to substantially coincide with each other in position and dimensions.

Figure 14:
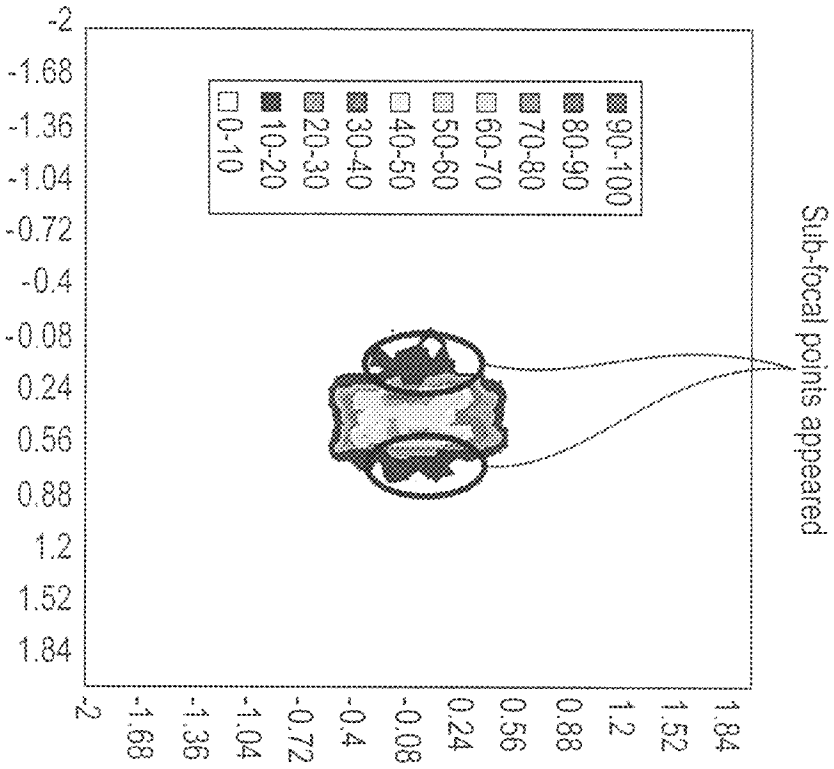
FIG. 14 is a diagram illustrating an in-focus image Fb calculated such as to be equivalent to that of the pinhole camera method in the X-ray tube of the comparative example.

FIG. 14 shows an effective focal spot Fa formed on the target surface S. The width of the effective focal spot Fa in the direction dd along the direction of rotation of the anode target 60 was 0.753 mm, which was larger than that of the example. The length of the effective focal spot Fa in the direction de along the tube axis al was 1.040 mm, which was slightly larger than that of the example.

Next, the example and the comparative example will now be compared and contrasted with each other in the emission of the electron beam.

FIGS. 6 and 13 show the results of the example and comparative example. As shown, there are some cases in the example that electrons released from the side surface of the filament coil 11 collide with the closest inner circumferential wall 53 or were bent by the electric field produced by the inner circumferential wall 53, so that the electrons did not reach the anode target. On the other hand, in the comparative example, electrons released from the side surface of the filament coil were bent by the electric field produced by the lower inner circumferential wall 52 but they reached the anode target. Thus, in the example, the electrons released from the side surface of the filament coil do not contribute to the formation of the focal spot. In contrast, in the comparative example, the electrons, whose direction was bent by the lower inner circumferential wall, reach an undesired outer portion of the main focal spot on the target surface S, to make a sub-focal spot, and thus the focal spot does not fit in the desired size.

Next, the example and comparative example will be compared and contrasted in the state of focal spot.

As shown in FIGS. 7 and 14, a substantially rectangular focal spot was obtained in the example although slight sub-focal spots were observed, whereas in the comparative example, there were strong sub-focal spots, which makes it no longer possible to maintain a square focal spot.

According to the X-ray tube assembly having the above-described structure of the example according to the first embodiment, the X-ray tube 1 comprises an anode target 60 configured to radiate X-rays by incidence of an electron beam, a cathode 10 comprising an electron converging cup 15, and a vacuum envelope 70 accommodating the anode target 60 and the cathode 10.

The electron converging cup 15 comprises filament coils configured to emit electrons (first to third filament coils 11 to 13) and trench portions (first to third trench portions 16 to 18) in which the first to third filament coils are respectively accommodated. The electron converging cup 15 is configured to converge an electron beam towards the anode target 60 through an opening of the trench portions (openings 16*a* to 18*a*) as the electrons are emitted from each of the respective filament coils.

Each of the trench portions (first to third trench portions 16 to 18) comprises a closest inner circumferential wall 53, an upper inner circumferential wall 51 and a lower inner circumferential wall 52. The closest inner circumferential wall 53 has a dimension shorter than a dimension of the respective filament coil in the depth direction of the trench portion (third direction dc), and faces the filament coil 11 with a narrowest gap between the closest inner circumferential wall 53 and the filament coil 11 over an entire circumference of the filament coil 11 in the width direction of the trench portion (or the electron emission source). The upper inner circumferential wall 51 is located on the opening side of the trench portion than the closest inner circumferential wall 53, and has a shape widening in the width direction further from the closest inner circumferential wall 53. The lower inner circumferential wall 52 is located on the opposite side to the upper inner circumferential wall 51 with respect to the closest inner circumferential wall 53, and has a shape widening in the width direction further from the closest inner circumferential wall 53.

With the above-described structure, the X-ray tube assembly of the example can obtain such advantages as listed in the following.

(1) As for the X-ray tube assembly of the comparative example, there is no effective means to make the electron density distribution within a focal spot uniform and make a focal spot having desirable dimensions simultaneously, whereas for the X-ray tube assembly of the example, there is such effective means. Further, in the X-ray tube assembly of the example, the X-ray tube 1 can be formed so that the sub-focal spot fits inside the main focal spot, or more preferably, if possible, the position and dimensions of the main focal spot substantially coincide with those of the sub-focal spot.

Since each trench portion comprises a closest inner circumferential wall 53, an upper inner circumferential wall 51 and a lower inner circumferential wall 52, an electron beam can be reliably converged even if the space between the filament coil and the trench portion (closest inner circumferential wall 53) is made larger than that of the comparative example. Further, with the closest inner circumferential wall 53, it is possible to make it difficult for the electrons emitted from the side surface of the filament coil to reach the anode target, and thus the electron density distribution of sub-focal spots can be suppressed at low level.

(2) As for the X-ray tube assembly of the comparative example, there is no effective means to suppress a sub-focal spot and increase the dimensions of the lower inner circumferential wall simultaneously, whereas for the X-ray tube assembly of the example, there is such effective means.

A focal spot of the same dimensions can be obtained between when the gap Ya is set to about 0.15 mm in the comparative example and when the gap Yb is set to about 0.485 mm in the example. That is, the dimensions of a focal spot can be reduced by further decreasing the gap Yb.

Here, when the gap Yb is set to 0.2 mm or more, or more preferably, 0.3 mm or more, the dimensions of a focal spot can be reduced while preventing filament touch and the occurrence of electric breakdown between the filament coil and the electron converging cup 15.

(3) As for the X-ray tube assembly of the comparative example, there is no effective means to suppress a sub-focal spot and obtain a focal spot of desirable dimensions simultaneously, whereas for the X-ray tube assembly of the example, there is such effective means.

As described above, each trench portion comprises a closest inner circumferential wall 53, an upper inner circumferential wall 51 and a lower inner circumferential wall 52. By appropriately setting the dimensions of these, it is possible to suppress sub-focal spots and obtain a focal spot of desirable dimensions without adjusting the gap between the anode target 60 and the cathode 10. In other words, it is possible to obtain a focal spot having a uniform electron density distribution therewithin and desirable dimensions while maintaining a voltage durability between the anode target 60 and the cathode 10.

(4) As for the X-ray tube assembly of the example, it is possible to make the electron density distribution uniform within a focal spot and obtain a focal spot of desirable dimensions without curving the upper inner circumferential wall 51. Therefore, the design and processing costs can be reduced as compared to the case where the upper inner circumferential wall 51 should be curved.

As described above, it is possible to realize an X-ray tube 1 which can make the electron density distribution uniform within a focal spot and obtain a focal spot of desirable dimensions, and also an X-ray tube assembly comprising such an X-ray tube 1.

An X-ray tube assembly according to the second embodiment will now be described in detail. In this embodiment, the structural members other than those which will be particularly discussed are identical to those of the first embodiment, and therefore they are designated by the same reference numbers and the detailed descriptions therefor will be omitted.

Figure 8:
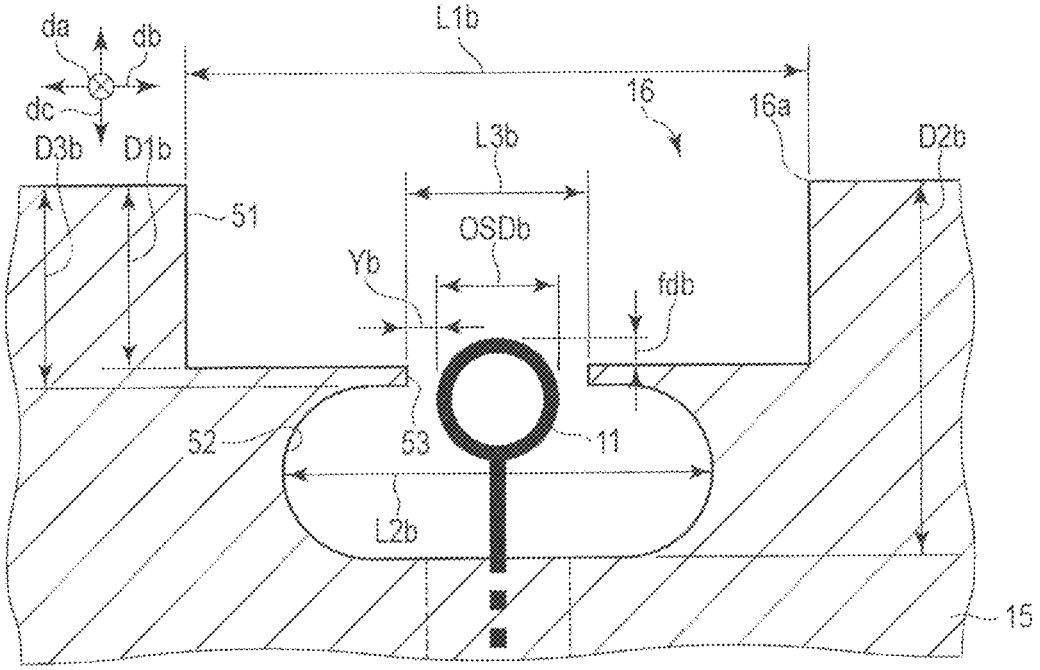
FIG. 8 is an enlarged cross-sectional view of an cathode of an X-ray tube assembly according to a second embodiment.

As shown in FIG. 8, the first trench portion 16 comprises a closest inner circumferential wall 53, an upper inner circumferential wall 51 and a lower inner circumferential wall 52. The closest inner circumferential wall 53 is formed into a substantially rectangular frame shape. The lower inner circumferential wall 52 is formed to pierce through the electron converging cup 15 in the first direction da. A cross section of the lower inner circumferential wall 52 in a plane in the second direction db and third direction dc has an ovally rounded rectangle. Here, the ovally rounded rectangle has two parallel lines with equal length, and two semi-circles with an equal radius.

Next, the processing of the lower inner circumferential wall 52 will now be described.

The lower inner circumferential wall 52 can be processed using, for example, a ball end mill. For example, the rotating shaft of the ball end mill is set in the first direction da, and the material is processed while being fed in the first direction da and the second direction db. Thus, the processing cost can be reduced as compared to the case where the discharge process is required (that is, the lower inner circumferential wall 52 is formed to have a rectangular frame shape). It is alternatively possible that a drill through-hole is made in the electron converging cup 15 in the same direction in advance before the ball end milling process.

According to the X-ray tube assembly having the above-described structure of the second embodiment, the X-ray tube 1 comprises an anode target 60 configured to radiate X-rays by incidence of an electron beam, a cathode 10 comprising an electron converging cup 15, and a vacuum envelope 70 accommodating the anode target 60 and the cathode 10.

Each of the trench portions (first to third trench portions 16 to 18) comprises a closest inner circumferential wall 53, an upper inner circumferential wall 51 and a lower inner circumferential wall 52. The cross section of the lower inner circumferential wall 52 in a plane in the second direction db and third direction dc may have an ovally rounded rectangle. In this case as well, a similar advantageous effect to that of the first embodiment can be obtained by adjusting the dimensions of the lower inner circumferential wall 52.

The lower inner circumferential wall 52 is formed by making a through-hole to extend in the first direction da in the electron converging cup 15. Thus, the lower inner circumferential wall 52 can be formed merely by making the through-hole, and no such a process of blocking the through-hole is required later. Therefore, the processing cost of the lower inner circumferential wall 52 can be reduced as compared to the first embodiment previously described.

Accordingly, it is possible to realize an X-ray tube 1 which can make the electron density distribution uniform within a focal spot and obtain a focal spot of desirable dimensions, and also an X-ray tube assembly comprising such an X-ray tube 1. Further, the above-described X-ray tube 1 can prevent the occurrence of both filament touch and electric breakdown between the filament coils and electron converging cup 15 at the same time.

Next, a modified example of the X-ray tube assembly according to the second embodiment will now be described.

Figure 9:
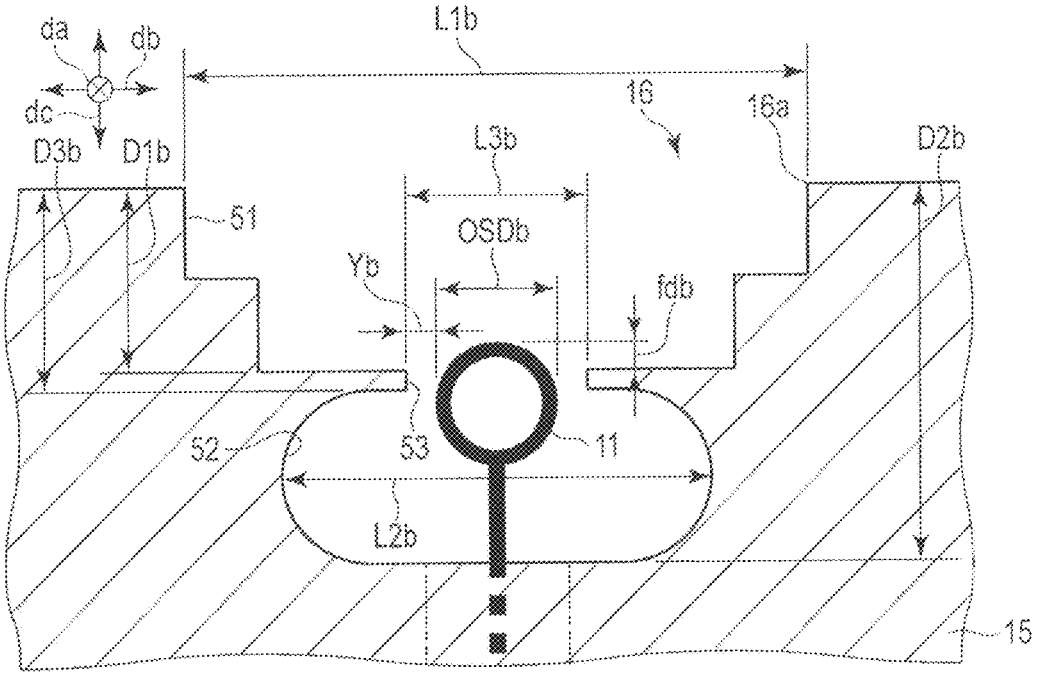
FIG. 9 is an enlarged cross-sectional view of a modified example of the cathode of the X-ray tube assembly according to the second embodiment.

As shown in FIG. 9, the upper inner circumferential wall 51 is formed to be multistage. In this example, the upper inner circumferential wall 51 is of a two-stage. Each stage of the upper inner circumferential wall 51 is formed to have a rectangular frame shape. The stage on the nearer side to the closest inner circumferential wall 53 formed into a shape widening further from the closest inner circumferential wall 53 in the width direction (second direction db). The stage on the nearer side to the opening 16*a* in the upper inner circumferential wall 51 is formed to have the same dimensions as those of the opening (opening 16*a*) in a plane in the first direction da and the second direction db into a shape widening further from the stage on the nearer side to the closest inner circumferential wall 53 in the width direction (second direction db).

In this case as well, a similar advantageous effect to that of the second embodiment can be obtained by adjusting the dimensions of the upper inner circumferential wall 51. Further, with the multistage structure of the upper inner circumferential wall 51, this example exhibited such an advantage that the electron density distribution can be made uniform within a focal spot and a focal spot of desirable dimensions can be obtained.

Next, another modified example of the X-ray tube assembly according to the second embodiment will now be described.

Figure 10:
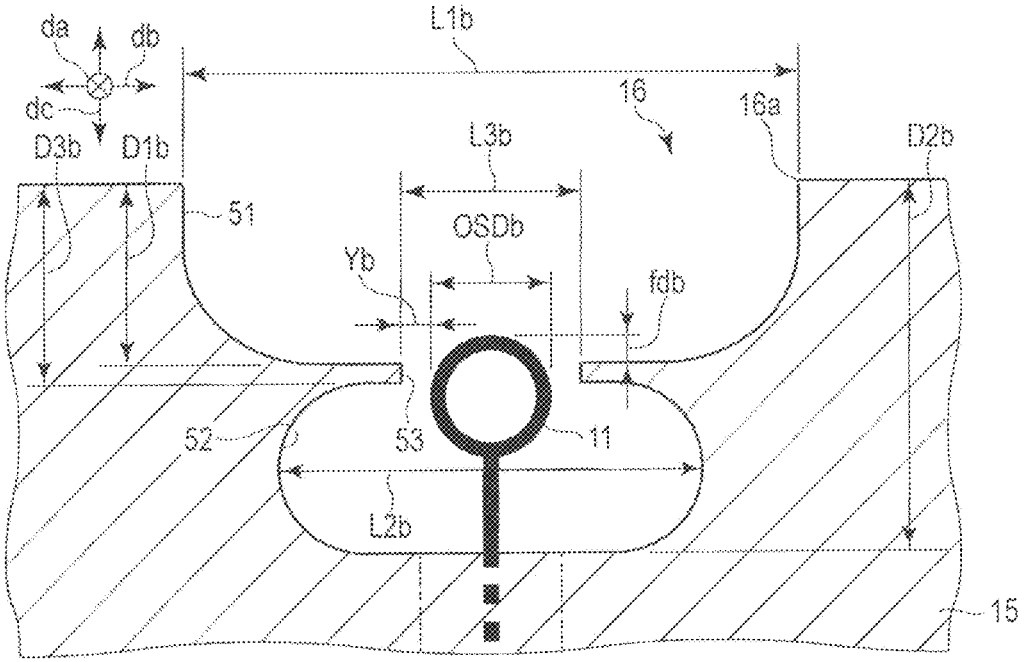
FIG. 10 is an enlarged cross-sectional view of another modified example of the cathode of the X-ray tube assembly according to the second embodiment.

As shown in FIG. 10, the upper inner circumferential wall 51 is formed to have a curved surface shape. More specifically, a cross section of the upper inner circumferential wall 51 has a curved surface shape in a plane in the second direction db and the third direction dc.

In this case as well, a similar advantageous effect to that of the second embodiment can be obtained by adjusting the curved surface shape of the upper inner circumferential wall 51. Further, with the curved surface structure of the upper inner circumferential wall 51, this example exhibited such an advantage that the electron density distribution can be made uniform within a focal spot and a focal spot of more desirable dimensions can be obtained.

Next, an X-ray tube assembly according to the third embodiment will now be described in detail. In the embodiment, the structural members other than those which will be particularly discussed are identical to those of the first embodiment, and therefore they are designated by the same reference numbers and the detailed descriptions therefor will be omitted.

Figure 11:
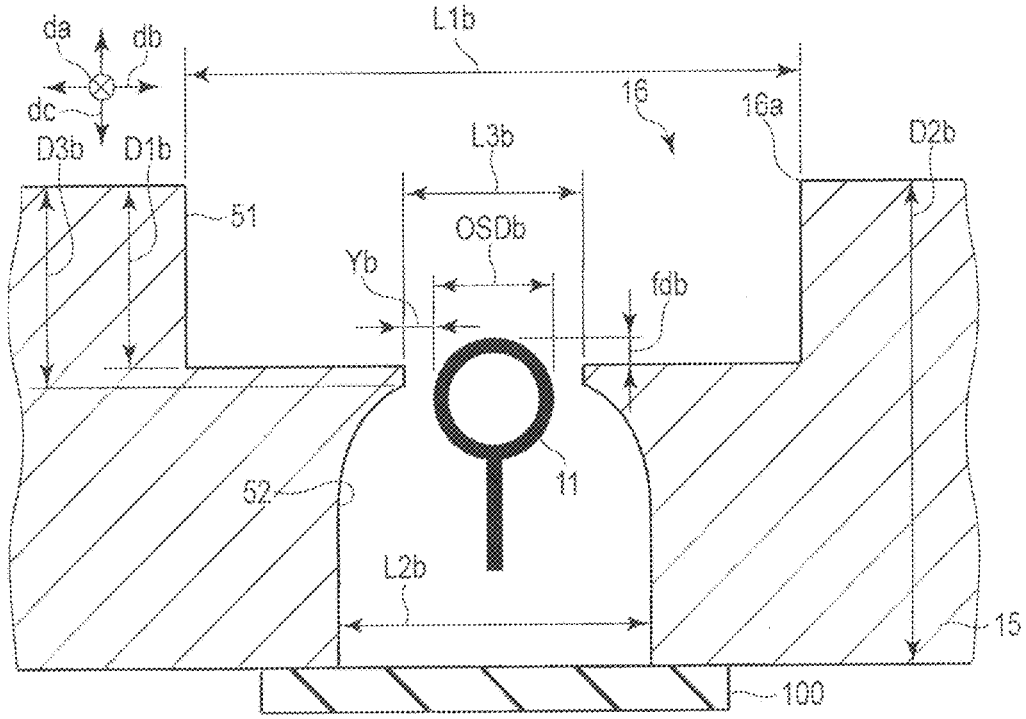
FIG. 11 is an enlarged cross-sectional view of an cathode of an X-ray tube assembly according to a third embodiment.

As shown in FIG. 11, the lower inner circumferential wall 52 has a curved surface shape. A cross section of the lower inner circumferential wall 52 has such a curved surface shape as a part of a circle in a plane in the second direction db and the third direction dc. The lower inner circumferential wall 52 is formed into a shape widening further from the closest inner circumferential wall 53 in the width directions (the first direction da and the second direction db) in a plane in the first direction da and the second direction db. The lower inner circumferential wall 52 can be processed, for example, in the following manner. The rotating shaft of the ball end mill is set in the third direction dc, and the material is processed while being fed in the first direction da and the third direction dc.

An insulating member 100 is secured to the electron converging cup 15. The insulating member 100 is placed to face the lower inner circumferential wall 52. In this embodiment, the insulating member 100 is formed of ceramics and brazed to the electron converging cup 15. The insulating member 100 is configured to support each respective filament coil (first to third filament coils 11 to 13) and regulate (secure) the position of the respective filament coil.

According to the X-ray tube assembly having the above-described structure of the third embodiment, the X-ray tube 1 comprises an anode target 60 configured to radiate X-rays by incidence of an electron beam, a cathode 10 comprising an electron converging cup 15, and a vacuum envelope 70 accommodating the anode target 60 and the cathode 10.

Each of the trench portions (first to third trench portions 16 to 18) comprises a closest inner circumferential wall 53, an upper inner circumferential wall 51 and a lower inner circumferential wall 52. The cross section of the lower inner circumferential wall 52 in a plane in the second direction db and third direction dc may have a curved surface shape. In this case as well, a similar advantageous effect to that of the first embodiment can be obtained by adjusting the dimensions of the lower inner circumferential wall 52.

The lower inner circumferential wall 52 can be processed using a ball end mill. Therefore, the processing cost of the lower inner circumferential wall 52 can be reduced as compared to the first embodiment previously described.

As described above, it is possible to realize an X-ray tube 1 which can make the electron density distribution uniform within a focal spot and obtain a focal spot of desirable dimensions, and also an X-ray tube assembly comprising such an X-ray tube 1. Further, the above-described X-ray tube 1 can prevent the occurrence of both filament touch and electric breakdown between the filament coils and electron converging cup 15 at the same time.

It should be noted that the embodiments and modifications discussed here are presented merely examples, and are not intended to limit the scope of each embodiment. These novel embodiments can be carried out in various modifications, and they may be subjected to various omissions, replacements and variations as long as the essence of the embodiments remains. These embodiments and modifications naturally fall within the scope of the embodiments and are covered by the embodiments recited in the claims as well as their equivalencies.

For example, each of the trench portions (first to third trench portions 16 to 18) may further comprises one or more other upper inner circumferential walls located on the respective opening (openings 16*a* to 18*a*) side than the closest inner circumferential wall 53 and having dimensions larger than those of the closest inner circumferential wall 53, and/or one or more other lower inner circumferential walls located on the opposite side to the upper inner circumferential walls 51 with respect to the closest inner circumferential wall 53 and having dimensions larger than those of the closest inner circumferential wall 53.

Each of the trench portions (first to third trench portions 16 to 18) may further comprise one or more other closest inner circumferential walls shorter than a dimension of the respective filament coil (electron emission source) in the depth direction of the trench portion (third direction dc), and faces the filament coil with a narrowest gap between said other closest inner circumferential walls and the filament coil over an entire circumference thereof in the width direction of the electron emission source.

The upper inner circumferential wall 51 may be formed into a squarish, a circular or an ovally rounded rectangle.

The cross section of the lower inner circumferential wall 52 in a plane in the second direction db and third direction dc may have the shape of a circle, an ovally rounded rectangle or a portion thereof.

The first to third filament coils 11 to 13 may be of different types from each other, or they may differ from each other in properties (electron emission amount). For example, the dimensions of a respective one of the filament coils may be varied to change the dimensions of the focal spot.

The number of filament coils (electron emission sources) and trench portions provided in the cathode 10 is not limited to 3, but the structure may be modified in various ways to have 1, 2 or 4 or more of coils or trench portions.

The electron emission sources may be modified in various ways, and for example, any type of thermoelectron emission source can be employed. Further, such a thermoelectron emission source may not be a filament coil. An electron emissive material may be made of a material comprising, for example, lanthanum boride ($LaB_6$) as a main component.

The X-ray tube assemblies of these embodiments are not limited to those described above, but may be modified in various ways. Thus, the embodiments are applicable to various types of X-ray tube assemblies, such as a stationary anode X-ray tube assembly.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray tube comprising:

an anode target configured to radiate X-rays by incidence of an electron beam;

a cathode comprising an elongated electron emission source configured to emit electrons, and a converging electrode including a trench portion accommodating the electron emission source, and configured to converge the electron beam towards the anode target through an opening of the trench portion as the electrons are emitted from the electron emission source, and a vacuum envelope accommodating the anode target and the cathode, wherein the trench portion comprises:

a closest inner circumferential wall extending linearly in a depth direction of the trench portion, having dimension shorter than dimension of the electron emission source in the depth direction of the trench portion, and facing the electron emission source with a narrowest gap between the closest inner circumferential wall and the electron emission source over an entire circumference of the electron emission source in width direction of the electron emission source, an upper inner circumferential wall located on the opening side of the trench portion with respect to the closest inner circumferential wall and having a shape widening in the width direction further from the closest inner circumferential wall, a lower inner circumferential wall located on an opposite side to the upper inner circumferential wall with respect to the closest inner circumferential wall and having a shape widening in the width direction further from the closest inner circumferential wall, the electron emission source projects towards the opening of the trench portion from a boundary between the closest inner circumferential wall and the upper inner circumferential wall, within an area through the electron emission source in the width direction at an imaginary cross section, a first distance between the lower inner circumferential wall and an imaginary line facing each other in the width direction is longer than a second distance between the closest inner circumferential wall and the imaginary line facing each other in the width direction, and the imaginary line extends through an end of the electron emission source in the width direction, and extends in the depth direction.

2. The X-ray tube of claim 1, wherein the electron emission source is formed of a material of tungsten as a main component.

3. The X-ray tube of claim 1, wherein the trench portion further comprises at least one of:

one or more other upper inner circumferential walls located on the opening side of the trench portion than the closest inner circumferential wall and having a shape widening in the width direction from the closest inner circumferential wall; and one or more other lower inner circumferential walls located on an opposite side to the upper inner circumferential walls with respect to the closest inner circumferential wall and having a shape widening in the width direction from the closest inner circumferential wall.

4. The X-ray tube of claim 1, wherein the gap between the electron emission source and the closest inner circumferential wall is 0.2 mm or more.

5. The X-ray tube of claim 1, wherein the upper inner circumferential wall has a curved surface shape.

6. The X-ray tube of claim 1, wherein a cross section of the lower inner circumferential wall in the width direction has a shape of a circle, an ovally rounded rectangle or a portion thereof.

7. The X-ray tube of claim 1, wherein within the area, the first distance increases with increasing distance from the opening.

* * * * *